US005546728A

United States Patent [19]

Dekeyser

[11] Patent Number: 5,546,728

[45] Date of Patent: Aug. 20, 1996

[54] DEVICE FORMING PACKAGING FOR QUANTITIES OF A GLUTINOUS SUBSTANCE

[76] Inventor: Michel Dekeyser, Kestergat 22, B-1670, Pepingen, Belgium

[21] Appl. No.: 256,349

[22] PCT Filed: Dec. 18, 1992

[86] PCT No.: PCT/BE92/00054

§ 371 Date: Jul. 15, 1994

§ 102(e) Date: Jul. 15, 1994

[87] PCT Pub. No.: WO93/74003

PCT Pub. Date: Jul. 22, 1993

[30] Foreign Application Priority Data

Jan. 15, 1992 [BE] Belgium ..... 09200034

[51] Int. Cl.[6] ..... B65D 75/36

[52] U.S. Cl. ..... 53/133.1; 53/412; 222/107

[58] Field of Search ..... 53/453, 559, 412, 53/133.2, 133.1; 222/107

[56] References Cited

U.S. PATENT DOCUMENTS

| | | | |
|---|---|---|---|
| 2,705,579 | 4/1955 | Mason | 222/107 |
| 2,908,601 | 10/1959 | Brown | 53/133.1 X |
| 2,956,710 | 10/1960 | O'Connor | 222/107 |
| 3,917,116 | 11/1975 | Mason | 222/107 X |
| 4,331,264 | 5/1982 | Staar | 222/94 |
| 4,493,574 | 1/1985 | Redmond et al. | 222/107 X |
| 4,611,715 | 9/1986 | Redmond | 222/107 X |
| 4,793,121 | 12/1988 | Jamison | 53/133.1 X |

FOREIGN PATENT DOCUMENTS

| | | |
|---|---|---|
| 0025621 | 3/1981 | European Pat. Off. . |
| 0178918 | 4/1986 | European Pat. Off. . |
| WO91/11371 | 8/1991 | WIPO . |

*Primary Examiner*—James F. Coan

*Attorney, Agent, or Firm*—Oblon, Spivak, McClelland, Maier & Neustadt, P.C.

[57] ABSTRACT

Device constituting packaging for quantities of a glutinous substance, including first and second superposed sheets soldered together, of which a first, formable sheet has, for each quantity, a deformation extending away from the junction surface joining the two sheets and exists as a cavity forming a volume which holds the quantity of glutinous substance. The device also includes a duct for expelling the quantity of glutinous substance, which duct is open at one end thereof and which has a second end which opens into the cavity, as well as a flexible membrane forming a seal and producing a separation between the cavity and the duct in the area of the duct, the seal is attached to the first sheet so as to constitute a fragile seal at that site. The device is characterized by the fact that, at the site of the duct, the first and second sheets have no deformation prior to a soldering operation, and that the expulsion duct is formed by a non-soldered passage-shaped area arranged between the first sheet incorporating the cavity and the second sheet.

3 Claims, 1 Drawing Sheet

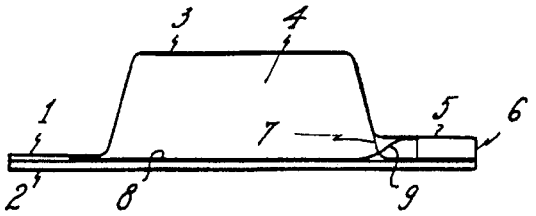
FIG. 1
FIG. 2 a
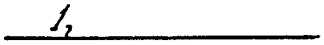
FIG. 2 b
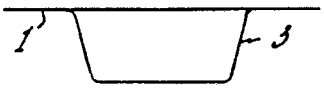
FIG. 2 c
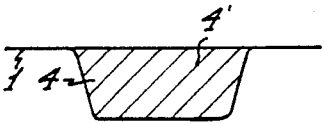
FIG. 2 d
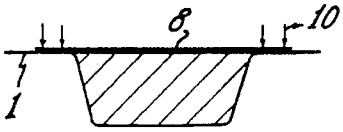
FIG. 2 e
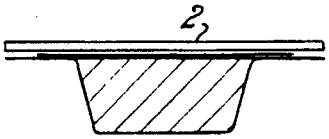
FIG. 2 f
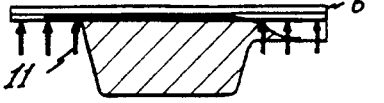
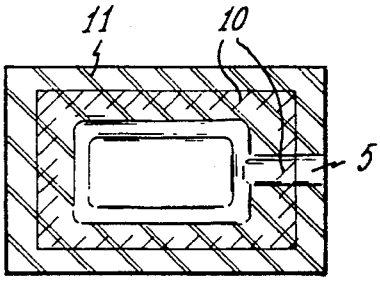
FIG. 3

DEVICE FORMING PACKAGING FOR QUANTITIES OF A GLUTINOUS SUBSTANCE

BACKGROUND OF THE INVENTION

1. Technical Field

The present invention concerns a device constituting packaging for quantities of a glutinous substance.

2. Background Art

A device of this kind and the process for manufacture of said device have been described in patent application No. WO-A-9111371 in the name of the present Applicant.

This prior document discloses a device for storage and distribution of quantities of a glutinous substance, comprising a volume used to hold the quantity of glutinous substance and means for sealing this volume, which can be opened for distribution of the quantity of glutinous substance, this device being made of two superposed sheets solidly joined together, of which the first, formable sheet comprises, for each quantity, a deformation extending away from the junction surface joining the two sheets and existing as a cavity forming the volume in which the glutinous substance is held, this device further comprising a duct for the expulsion of the quantity of glutinous substance and forming a nonsoldered, passage-shaped area arranged between the first sheet incorporating the cavity and the second sheet, this duct being open at one of its ends and opening at the other end into the cavity, and a flexible membrane constituting sealing means and separating the cavity from the duct and which, in the duct area, is assembled to said first sheet in which the cavity is formed in order to produce, at that site, a seal which is fragile or can be easily be torn open. These components form part of the device according to the present invention.

However, in this prior document the second sheet incorporates, prior to soldering this second sheet to the first, a second deformation in the form of a passage forming an expulsion duct and also extending away from the junction surface at which the sheets are joined.

The presence of this second passage-shaped deformation extending away from the cavity in which the quantity of glutinous substance is held makes possible the use of a flat membrane which, arranged in the plane of the junction of the first and second sheets, produces the separation between the cavity and the passage arranged on either side of this plane of junction.

This passage, which projects outward on the package surface opposite the cavity in which the quantity of glutinous substance is held, on the one hand complicates production of the device, and, on the other, increases the bulk of the packaging.

DISCLOSURE OF THE INVENTION

The invention is thus intended to solve these difficulties by producing a packaging of the aforementioned type, in which, in the area of the duct for expulsion of the quantity of glutinous substance, one of two possible assemblies exist. In the first assembly, neither of the first and second sheets is deformed and the expulsion duct is formed exclusively as a result of the existence of the non-soldered area. In the second assembly, the first sheet is deformed, the flexible membrane assuming the shape of this deformation of the first sheet in the area in which it is attached to it and the second sheet comprises a flat sheet having a stiffness greater than that of the first sheet.

According to a preferred embodiment of the invention, the fragile or easily-tearable seal formed within the expulsion duct by the membrane attached to said first sheet incorporating the cavity is produced by effecting a fragile attachment of the membrane to said first sheet.

According to another feature of the invention, the fragile seal formed within the expulsion duct by the membrane assembled to said first sheet incorporating the cavity is formed by a prenotched weakened zone produced in the membrane.

The invention also relates to the process for manufacture of a device of this kind.

The aforementioned prior document No. WO-A-9111371 also describes a process for manufacture of a device constituting the packaging for quantities of a glutinous substance, in which cavities are produced in the first sheet made of a formable material; the cavities are filled with quantities of a glutinous substance and a flexible membrane is laid down at least partially over the cavities and over the area which, in relation to each cavity, constitutes an expulsion duct for that cavity; the flexible membrane is bonded to the first sheet at least in the area corresponding to the expulsion duct; a second sheet covering the first sheet is placed over the assembly thus produced; and the first and second sheets, including the flexible membrane, are solidly soldered together, at least in the peripheral area of each cavity and in the area extending between each cavity and the corresponding edge of the device, while allowing a non-soldered passage originating in the cavity and ending at the edge to remain in this area, at the site of the expulsion duct. These steps of the process are also implemented in the process according to the present invention.

However, in the process as conventionally known, before soldering the first to the second sheet the ducts are formed in second sheet and the first and second sheets are juxtaposed by their sides extending away from the deformation.

On the other hand, in accordance with the present invention and at the soldering stage, the second sheet is a flat sheet and no deformation forming a passage for the expulsion duct is produced in the first sheet prior to soldering.

According to another feature of the invention process, the flexible membrane is laid down on the sheet incorporating the cavities, so as to extend beyond these cavities on all sides; a solder joint is made between the deformable membrane and the sheet incorporating the cavities over the entire periphery of each cavity; the second sheet, which has a stiffness greater than that of the first sheet, is placed over the assembly thus formed; the second sheet is heat-soldered to the assembly composed of the first sheet and the flexible membrane over the entirety of their junction surface, with the exception of the areas occupied by the cavities and of the passage joining each cavity to the edge of the device and constituting an expulsion duct, the heat of the solder joint producing a durable bond between the first sheet, the membrane, and the second sheet over the entirety of the soldered area and producing, in the non-soldered passage, a duct-shaped deformation of the first sheet attached to the deformable membrane.

According to a supplementary feature of the process according to the invention, during the step in which the flexible membrane is attached to the sheet incorporating the cavities, the solder joint produced between said membrane and this sheet is weak and fragile.

According to another feature of the process according to the invention, prior to the step in which the flexible membrane is attached to the sheet incorporating the cavities, the flexible membrane is preliminarily notched so as to incorporate fragile weakened areas, and is then positioned over the sheet incorporating the cavities, so that the prenotched areas are arranged at the sites of the passages between the cavities and the edge of the device, these passages being formed during the subsequent step when the first sheet is soldered to the second sheet.

BRIEF DESCRIPTION OF THE DRAWINGS

The invention will be better understood by referring to the following description and to the attached drawings, which illustrate, solely as an example, an embodiment of the invention and in which:

FIG. 1 is a cross-section view of a preferred embodiment of the device according to the invention;

FIGS. *2a–2f* illustrates the various steps of the process according to the invention used to produce the device; and FIG. 3 is a plane view of the device, in which the areas in which the various solder joints are produced are indicated in cross-hatching.

BEST MODE FOR CARRYING OUT THE INVENTION

With reference to the drawings, and more especially to FIG. 1, the device is made of two superposed sheets 1, 2 solidly soldered to each other. A deformation in the shape of a cavity 3 forming the volume 4 in which the quantity of glutinous substance is held is produced in the first sheet 1, which is made of a heat-formable material such as polyvinyl chloride. This first sheet also comprises a duct 5 used to expel the quantity of glutinous material, which is open at one of its ends 6 and opens into the cavity 3 at its other end 7. A flexible membrane 8 constituting sealing means produces a separation 9 between the cavity 3 and the duct 5, and is connected to the sheet 1 in the area of the duct 5 so as to form a fragile seal at that point. The duct 5 is made simply of a non-soldered passage arranged between sheets 1 and 2.

According to the preferred embodiment of the invention illustrated in FIG. 1, the wall of the duct 5 formed in the sheet 1 is deformed during the operation in which the first sheet is soldered to the second sheet to form the duct. The membrane 8 soldered to this wall has the shape of this deformation, while the sheet 2, which is flat and is made, for example, of polyethylene and has a stiffness greater than that of the sheet 1, undergoes no deformation during this same soldering operation.

Still according to this preferred embodiment illustrated in FIG. 1, the fragile seal of the cavity 3 is produced as a fragile bond between the membrane 8 and the wall of the duct 5 formed in the sheet 1.

However, provision could also be made for producing this bond attaching the membrane 8 to the wall 5 as a strong bond and for producing a pre-notched weakened area forming the fragile seal of the cavity 3 in the portion of the membrane 8 forming the separation 9 between the cavity 3 and the duct 5.

This design of the packaging device makes it possible, on the one hand, to reduce the thickness of the packaging, and, on the other, to use for the second sheet incorporating no deformation, a material stiffer than that used for the first heat-formable sheet, thereby giving the package a better appearance when several quantities are brought together in a single package.

In addition, the process for making a package such as that described above is simplified as compared with prior processes. The production steps of the process according to the invention are illustrated in FIGS. *2a–2f* These steps, which, in the example shown, are limited solely to the production of a single cavity, are as follows:

- A cavity 3 (FIG. *2b*) is formed in a flat heat-formable sheet (FIG. *2a*);
- A quantity 4' of a glutinous material (FIG. *2c*) is placed in the volume 4 of this cavity;
- A flexible membrane 8 is placed over the surface of sheet 1 facing in the direction opposite the cavity 3, so that this membrane extends beyond the outline of the cavity on all sides, and a weak solder joint 10 attaching the membrane 8 to the sheet 1 is produced around the entire circumference of the cavity (FIG. *2d*);
- A second sheet 2 possessing stiffness greater than that of the first sheet 1 is placed on the assembly thus formed (FIG. *2e*);
- The second sheet 2 is then firmly heat-soldered at point 11 to the assembly composed of the first sheet 1 and the membrane 8 over the entirety of their junction surface, with the exception of the area occupied by the cavity 3 and the passage 5 joining the cavity 3 to the edge 6' of the packaging, while allowing the sheet 1 and the membrane 8 attached to it to become deformed under heat in the area of the passage 5, so as to produce a duct-shaped deformation.

In another embodiment of the process, the flexible membrane 8 may be placed only over a portion of the cavity 3 and of the passage 5 forming the expulsion duct, and the flexible membrane 8 can be soldered to the first sheet 1 only in the area of the passage 5. At the time of the subsequent strong soldering operation joining the first to the second sheet, the membrane 8 is incorporated into this strong solder joint 11 and held in place over the entire circumference of the cavity 3 and on the edges of the duct 5.

When using a flexible membrane having, in the area of the seal of the duct 5, a pre-notched weakened zone, care must be taken when placing the membrane on the first sheet to make this weakened zone coincide with the area set aside for the duct 5.

I claim:

1. Device forming packaging for quantities of a glutinous substance, which comprises:

a volume holding a quantity of glutinous substance and a seal sealing this volume, which is openable for distribution of said quantity of glutinous substance;

first and second sheets which are superposed and firmly soldered to each other, wherein the first sheet comprises a deformation extending away from a surface joining the two sheets and including a cavity forming the volume in which the glutinous substance is held;

a duct for expulsion of the dose of glutinous substance, said duct forming a non-soldered, passage-shaped area positioned between the first sheet incorporating the cavity and the second sheet, said duct being continuously open at a first end thereof and opening at an opposite end thereof into the cavity; and a flexible membrane which forms the seal, said membrane separating the cavity from the duct wherein the membrane in an area of the duct, is connected to said first sheet in order to form a fragile seal, and at the duct, one of a first and second assembly exists wherein in the first assembly, neither of the first and second sheets is deformed and the duct is formed exclusively as a result of the existence of the non-soldered area and wherein, in the second assembly, the first sheet is deformed, the flexible membrane has the shape of the deformed first sheet in an area in which the flexible membrane is attached to said deformation and the second sheet comprises a flat sheet having a stiffness greater than that of the first sheet.

2. Device according to claim 1, wherein the fragile seal formed in the duct by the membrane attached to said first sheet comprises a fragile bond joining the membrane to said first sheet.

3. Device according to claim 1, wherein said fragile seal formed in the expulsion duct by the membrane attached to said first sheet comprises a pre-notched weakened zone formed in the membrane.

* * * * *

UNITED STATES PATENT AND TRADEMARK OFFICE

CERTIFICATE OF CORRECTION

PATENT NO. : 5,546,728

DATED : August 20, 1996

INVENTOR(S) : Michel DEKEYSER

It is certified that error appears in the above-indentified patent and that said Letters Patent is hereby corrected as shown below:

On the title page, Item [87], The PCT information should read:

--[87] PCT Pub. No.: WO93/14003
PCT Pub. Date: Jul. 22, 1993 --

Signed and Sealed this

Third Day of December, 1996

Bruce Lehman

*Attest:*

BRUCE LEHMAN

*Attesting Officer*

*Commissioner of Patents and Trademarks*